US008191813B2

(12) United States Patent
Haak

(10) Patent No.: US 8,191,813 B2
(45) Date of Patent: Jun. 5, 2012

(54) LAYING REEL FOR COILING ROLLED WIRE

(75) Inventor: Peter Haak, Willich (DE)

(73) Assignee: SMS Meer GmbH, Monchengladbach (DE)

( * ) Notice: Subject to any disclaimer, the term of this patent is extended or adjusted under 35 U.S.C. 154(b) by 364 days.

(21) Appl. No.: 12/147,559

(22) Filed: Jun. 27, 2008

(65) Prior Publication Data

US 2009/0001208 A1 Jan. 1, 2009

(30) Foreign Application Priority Data

Jun. 27, 2007 (DE) ..... 10 2007 029 811

(51) Int. Cl.
*B65H 54/00* (2006.01)
*B21C 47/14* (2006.01)

(52) U.S. Cl. ..... 242/361; 242/419.4

(58) Field of Classification Search ..... 242/361–361.5, 242/419.4, 419.5; 72/66, 135
See application file for complete search history.

(56) References Cited

U.S. PATENT DOCUMENTS

| | | | | | |
|---|---|---|---|---|---|
| 2,568,431 | A | * | 9/1951 | Congdon | 242/413.6 |
| 2,814,925 | A | * | 12/1957 | Vibber | 57/58.3 |
| 3,405,885 | A | | 10/1968 | Schroder | 242/361.3 |
| 3,469,429 | A | | 9/1969 | Dopper | 72/134 |
| 3,563,488 | A | | 2/1971 | Bollig | 242/82 |
| 4,046,064 | A | * | 9/1977 | Wahle | 493/44 |
| 4,306,688 | A | * | 12/1981 | Hechler, IV | 242/397 |
| 4,434,945 | A | * | 3/1984 | Hamane et al. | 242/419.8 |
| 5,312,065 | A | * | 5/1994 | Shore et al. | 242/361 |
| 6,345,780 | B1 | * | 2/2002 | Poloni et al. | 242/361.3 |
| 6,726,138 | B2 | | 4/2004 | Grimmel | 242/363 |
| 2006/0022080 | A1 | * | 2/2006 | Salvador | 242/419.4 |

FOREIGN PATENT DOCUMENTS

| | | | |
|---|---|---|---|
| DE | 1951667 | | 4/1971 |
| JP | 58209419 | A * | 12/1983 |
| SU | 1479159 | | 5/1989 |

* cited by examiner

*Primary Examiner* — Michael Mansen
*Assistant Examiner* — Scott Haugland
(74) *Attorney, Agent, or Firm* — Andrew Wilford

(57) ABSTRACT

A laying reel for coiling wire has a generally spiral laying tube generally centered on and rotatable about an axis and having offset from the axis a tangentially directed output end. The wire to be coiled extends through the tube and exits the output end thereof. A brake shoe at the output end is engageable with the wire extending therefrom. An actuator urges the brake shoe against the wire and thereby brakes the wire as it exits the output end.

9 Claims, 2 Drawing Sheets

LAYING REEL FOR COILING ROLLED WIRE

FIELD OF THE INVENTION

The present invention relates to a laying reel. More particularly this invention concerns such a reel for forming a coil of freshly rolled wire.

BACKGROUND OF THE INVENTION

A typical laying reel for depositing rolled wire, has a three-dimensional curved shape, and a laying tube that is rotatable about an axis, the wire exiting at the end thereof and being deposited in windings.

In the manufacture of wire, the wire is laid in coils by a laying reel. As the wire passes through the reel, the speed of the wire is determined by the last roll stand. After the end of the wire has left the last roll stand the speed is determined by the driver upstream from the laying head. For thin gauges and high speeds the driver must decelerate the wire. When the end of the wire has left the driver the wire is no longer decelerated, and the speed increases. As a result, the last turns have large diameters due to the so-called whiplash effect. This may lead to problems with subsequent devices.

A reel of a generic type is known from U.S. Pat. No. 3,563,488, for example. The reel illustrated and described therein is used for depositing wire in the form of separate turns on a conveyor belt. The rotary tube having a three-dimensional curved shape is modified at its exit end to the curvature of the turns to be formed and is enclosed by a stationary guide casing. To enable the wire to be deposited on the conveyor belt in uniform turns until its end is reached, the clearance diameter of the guide casing in the region of the end of the rotary tube is equal to the maximum outside diameter of the wire turns, and in addition a roller having a cylindrical running surface and mounted so as to be movable with respect to the guide casing is provided directly at he outlet end of the rotary laying tube.

In order to influence the shape of the last turns and to minimize the above-mentioned whiplash effect, it is also known to provide a worm screw immediately downstream of the outlet end of the laying tube. It serves to reduce the speed of the wire by friction. Depending on the roller speed, the material properties, and the temperature of the wire, however, the achievable effect is not always satisfactory. Furthermore, the worm screw used is very heavy, which may result in vibration problems.

OBJECTS OF THE INVENTION

It is therefore an object of the present invention to provide an improved laying reel for coiling rolled wire.

Another object is the provision of such an improved laying reel for coiling rolled wire that overcomes the above-given disadvantages, in particular that overcomes the above-mentioned problems.

A particular object is to provide a system of simple design that may be used to influence the end turns of the wire in a targeted manner.

SUMMARY OF THE INVENTION

A laying reel for coiling wire has according to the invention a generally spiral laying tube generally centered on and rotatable about an axis and having offset from the axis a tangentially directed output end. The wire to be coiled extends through the tube and exits the output end thereof. A brake shoe at the output end is engageable with the wire extending therefrom. An actuator urges the brake shoe against the wire and thereby brakes the wire as it exits the output end.

According to one preferred embodiment of the invention, the braking element has two brake shoes that may be pressed together by a controllable force. The brake shoes may have a flat design on the their side facing the wire, or at that location may also be designed to conform to the shape of the wire.

The braking element may be actuated by mechanical, electrical, pneumatic, hydraulic, or magnetic means, or by a combination of at least two of these means.

The brake shoes are advantageously provided as replaceable parts in or on their holders. This allows new brake shoes to be easily installed when wear occurs. In addition, the brake shoes are advantageously composed of a wear-resistant material.

It is particularly advantageous for the braking force exerted by the braking element to be controllable with or without feedback, so that in a specific case a desired braking effect may be achieved in order to provide optimal deceleration of the wire and thereby deposit it in turns.

The invention provides a simple apparatus that may be used to efficiently influence the exit speed of the wire from the laying tube. It is thus possible to influence the size of the last turn of the wire in a very controlled manner. Improving the end turns of the wire also results in less machine down-time, thus making the manufacture of the wire more economical.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
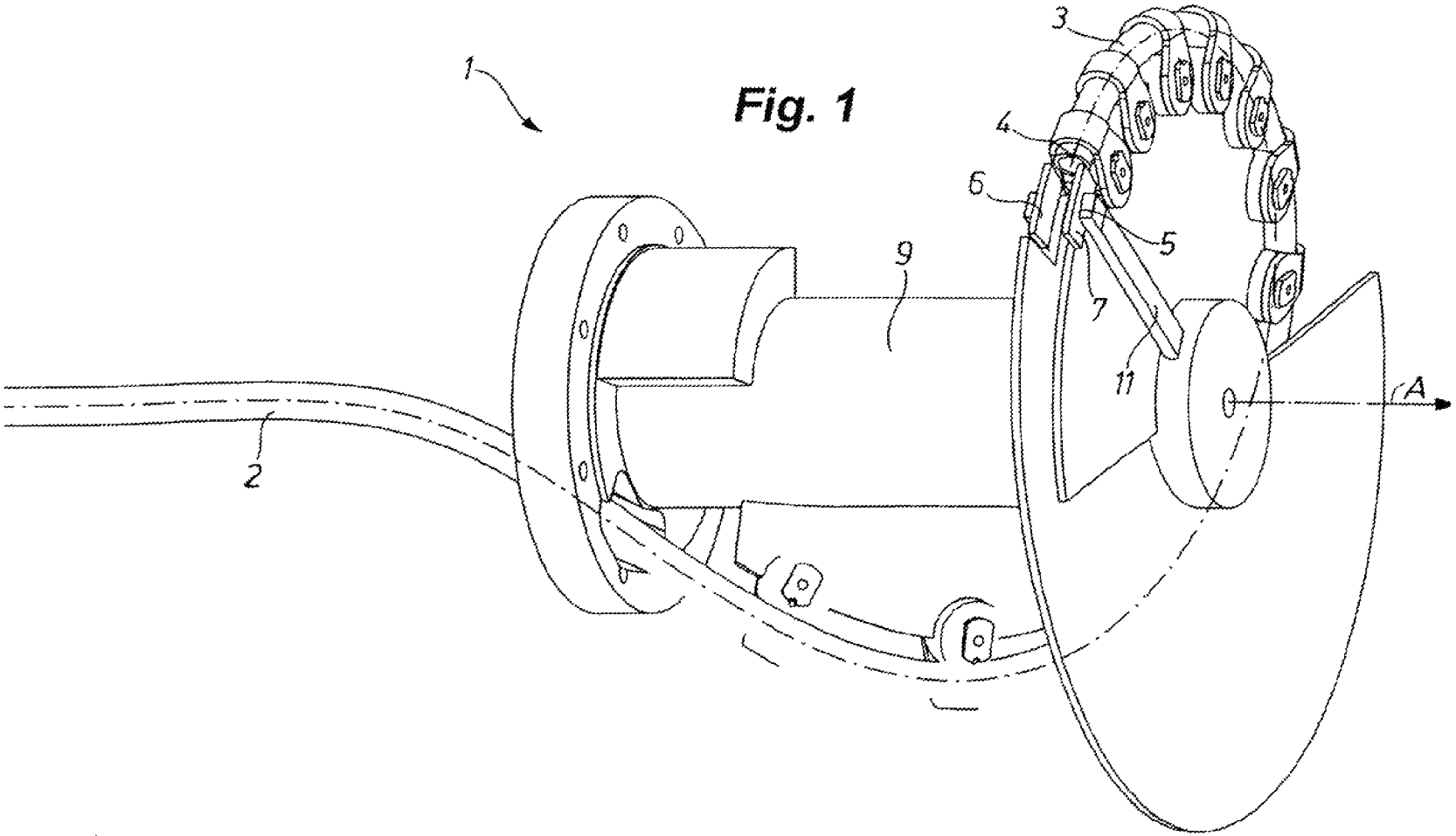
FIG. 1 is a perspective view of the laying reel according to the invention.

As seen in FIG. 1 a reel 1 has a tube support 9 that is rotatable about a rotational axis A. The tube support 9 carries a laying tube 3 having a three-dimensional curved shape, more specifically the shape of a spiral with an input end on the axis A and an outlet end 4 opening tangentially offset from the axis A. A rolled wire 2 that has come directly from an unillustrated wire roll stand extends through the guide tube 3. The reel 1 serves to lay this wire 3 on an unillustrated conveyor belt normally passing horizontally underneath the reel 1, to which end the axis A is normally vertical.

Figure 2:
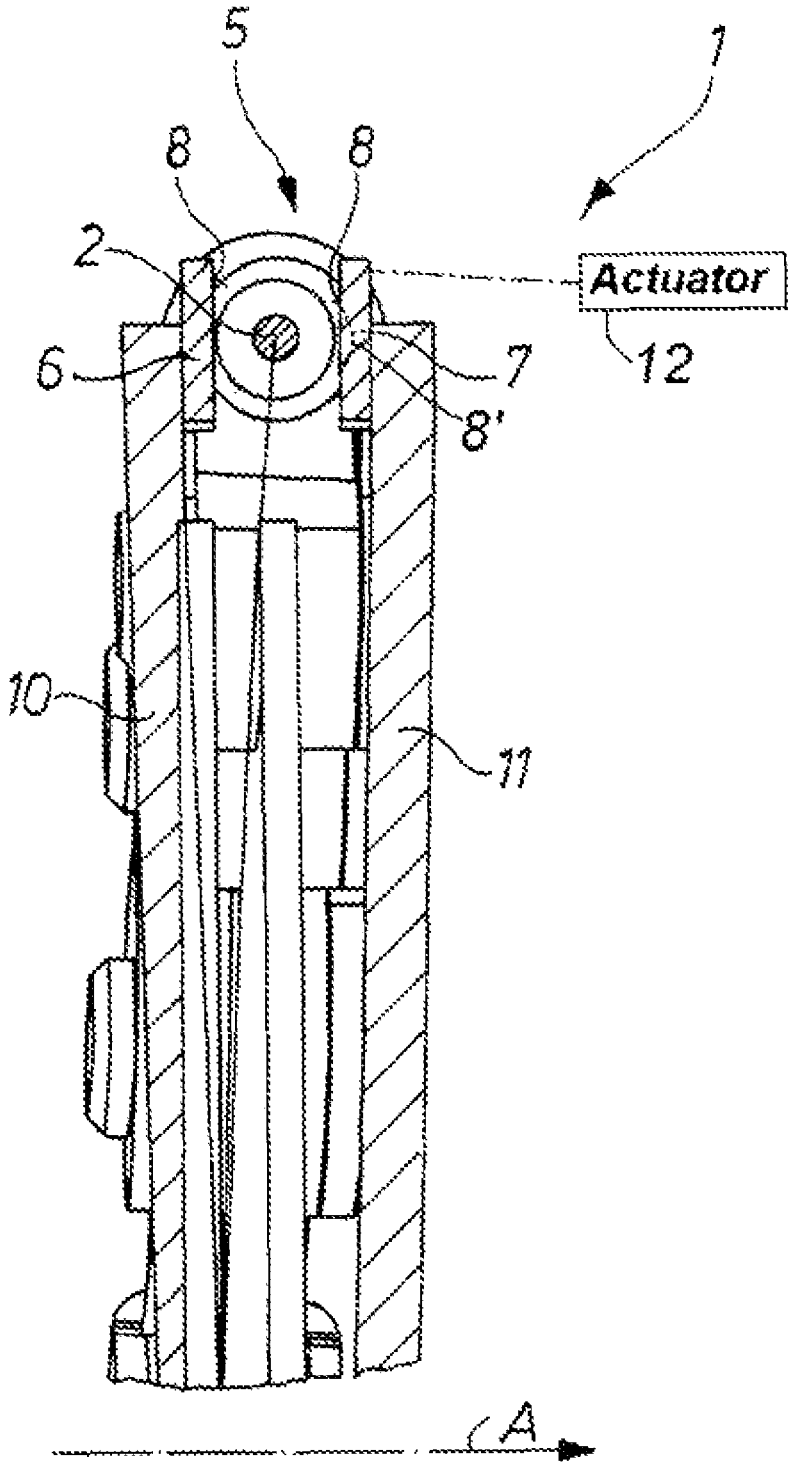
FIG. 2 is a radial section through the reel of FIG. 1.

In order to ensure that the wire 2 leaves the laying tube 3 at a predetermined speed, the outlet end 4 of the laying tube 3 has a braking element 5 that is mounted on the tube support 9 so as to rotate therewith about the axis A. In the illustrated embodiment, the braking element 5 has two rod-shaped brake shoe holders 10 and 11 that carry respective brake shoes 6 and 7 at their radial outer ends. The radial outer ends provided with the brake shoes 6, 7 are pressed together when the brake shoe holders 10 and 11 operated by an appropriate actuator illustrated schematically in FIG. 2 at 12.

The brake shoes 6 and 7 have planar faces 8 that axially confront each other and that are engageable with the wire 2. However, the contact surface of the brake shoes may also be modified to the outer shape of the wire 2, that is with an arcuate groove fitting the wire 2 as shown at dashed line 8' in FIG. 2.

As a result of the configuration and positioning of the braking element 5, the wire 2 exiting the laying tube 3 is clamped between the brake shoes 6 and 7 and decelerated.

The actuator 12 may be mechanical, electrical, pneumatic, hydraulic, or magnetic, or a combination of these means. The braking force may be controlled with or without feedback.

The speed of the wire may be reduced by means of the brake 5 installed at the end of the laying tube 3 and actuation of the brake. The braking force is variable, and is modified according to requirements. In other words, the clamping force that the brake shoes 6 and 7 exert on the wire 2 is selected according to the application and correspondingly controlled or regulated.

Because the brake shoes are mounted on the brake shoe holders 10 and 11 so as to be replaceable, the brake shoes 6, 7 may be easily exchanged in the event of advanced wear.

The material of the brake shoes is wear-resistant and thermally stable, thus ensuring a satisfactory service life.

I claim:

1. A laying reel for coiling wire, the reel comprising:

a support rotatable about an axis;

a generally spiral laying tube mounted on the support, generally centered on and rotatable about the axis and having a tangentially directed output end offset from the axis, the wire to be coiled extending through the tube and exiting the output end thereof tangentially of a circular path defined by the output end on rotation about the axis;

two holders mounted on the support, rotatable with the laying tube, and at the output end;

respective brake shoes removably mounted on the holders at the output end and engageable with the wire extending therefrom; and actuator means connected to the holders for clamping the wire between the brake shoes with a variable force and thereby braking the wire as it exits the output end.

2. The laying reel defined in claim 1 wherein the brake shoes have flat faces engageable with the wire.

3. The laying reel defined in claim 1 wherein the brake shoes have faces formed with grooves generally complementary to the wire.

4. The laying reel defined in claim 1 wherein the actuator means is electrically powered.

5. The laying reel defined in claim 1 wherein the actuator means is pneumatically powered.

6. The laying reel defined in claim 1 wherein the actuator means includes a solenoid.

7. The laying reel defined in claim 1 wherein the brake shoes are made of wear-resistant material.

8. The laying reel defined in claim 1, wherein the support has a shaft extending along the axis and carrying the laying tube, the holders having radial outer ends carrying the brake shoes and radial inner ends connected to the actuator means.

9. The laying reel defined in claim 1 wherein the tube further has an input end centered on and opening in line with the axis.

* * * * *